United States Patent [19]

Amann

[11] 3,979,053

[45] Sept. 7, 1976

[54] REFUSE DEVICE

[76] Inventor: Arthur M. Amann, Box 594, Lyman, Wyo. 82937

[22] Filed: Dec. 30, 1974

[21] Appl. No.: 537,128

[52] U.S. Cl. ..... 232/43.2; 232/43.4

[51] Int. Cl.[2] ..... B65D 91/00

[58] Field of Search ..... 232/43.2, 43.4, 19, 232/22, 45, 46; 248/99, 101

[56] References Cited

UNITED STATES PATENTS

| | | | |
|---|---|---|---|
| 449,593 | 3/1891 | Scott | 232/46 |
| 1,129,911 | 3/1915 | Smith et al. | 248/101 |
| 1,512,307 | 10/1924 | Pratt | 232/19 |
| 1,640,153 | 8/1927 | Kolstad | 232/19 |
| 2,062,639 | 12/1936 | Cartwright | 232/43.4 X |
| 3,211,367 | 10/1965 | Jessop | 232/43.2 |
| 3,233,854 | 2/1966 | Morgan | 248/99 |
| 3,270,957 | 9/1966 | Louchheim | 232/43.2 |
| 3,322,477 | 5/1967 | Armijo | 232/43.2 X |
| 3,327,937 | 6/1967 | Casady | 232/43.2 |
| 3,713,581 | 1/1973 | Mullens | 232/43.1 |

*Primary Examiner*—James C. Mitchell

[57] ABSTRACT

A refuse device for lining refuse passageway apertures and support members of whatever nature. The subject device includes a pair of flanges which are preferably telescoping and are mutually securable together such that their outer flange portions approximate the width of such support member. Suitable attachments are used to effect the mounting of the device together and in retentive relationship, relative to the support member the refuse passageway aperture of which accommodates such flanges. The outermost flange includes an additional flange portion proximate an interior, relief, and preferably roughened surface, this to accommodate the placement of a refuse bag over such flange; the latter is mounted by a rubber band, string, or other suitable fastening means. Cover means are provided.

1 Claim, 3 Drawing Figures

REFUSE DEVICE

The present invention relates to refuse devices and, more particularly, to a new and improved refuse device constructed to serve as a liner and also a bag support for support members of various kinds.

The present invention is constructed for use with the vertical walls, for example, of campers, trailers, mobile homes, and even regular residences; the structure is also suitable for use with a horizontal or even a vertical support or side of a trash container.

Prior devices of which the inventor is aware are believed cumbersome and especially expensive to manufacture. See the following U.S. Pat. Nos.: 3,713,581, George O. Mullens; 3,211,367, Jessop; 3,261,441, Mullens, G.V.; 449,593, Scott.

Clearly, the most inexpensive and direct way of accumulating trash is through use of a plastic or other type of bag. In the present invention, in contrast to the known prior art, the bag is actually suspended by the subject liner device, this through use of a flange and an interior recessed surface against which the sides of the bag are frictionally retained.

Specifically, the present invention in a preferred embodiment thereof comprises a pair of telescoping flanges, a preferred configuration of which is essentially round or cylindrical. These flanges include outer flange portions having apertures for receiving and accommodating attachments or mounts. These mounts may take the form of standard binder screws that are used in notebooks and for other purposes. Binder screw attachments, of course, include an outer, inwardly threaded tubular nut and also screw threading into such nut. Other types of attachments are possible.

The rings or flanges of the device are provided with apertures which can easily be aligned to effect or accommodate the mounting of the device to the subject aperture support member.

In a preferred form of the invention, the same includes an outer cap that serves as a closure member for the exterior port opening of the device. When the cap is removed and the refuse bag installed, in the manner hereinafter described, an inner closure, taking preferably the form of a radially slotted elastomeric member, is provided to keep objectionable odors and unsightly objects from the senses of persons in proximity.

Accordingly, a principal object of the present invention is to provide a new and improved refuse device for use in trash containers or even in the walls or other support structure of occupancy areas.

An additional object is to provide a double flange device for lining the pass-through holes of structures, wherein such liner is constructed to releasably mount a refuse bag on a side of such structure.

A further object is to provide closure structure for pass-through liners wherein objectionable odors and sights are kept from the senses and, additionally, wherein the pass-through structure can be closed off during occupant structure transit.

The features of the present invention may best be understood by reference to the following description taken in connection with the accompanying drawings in which.

Figure 1:
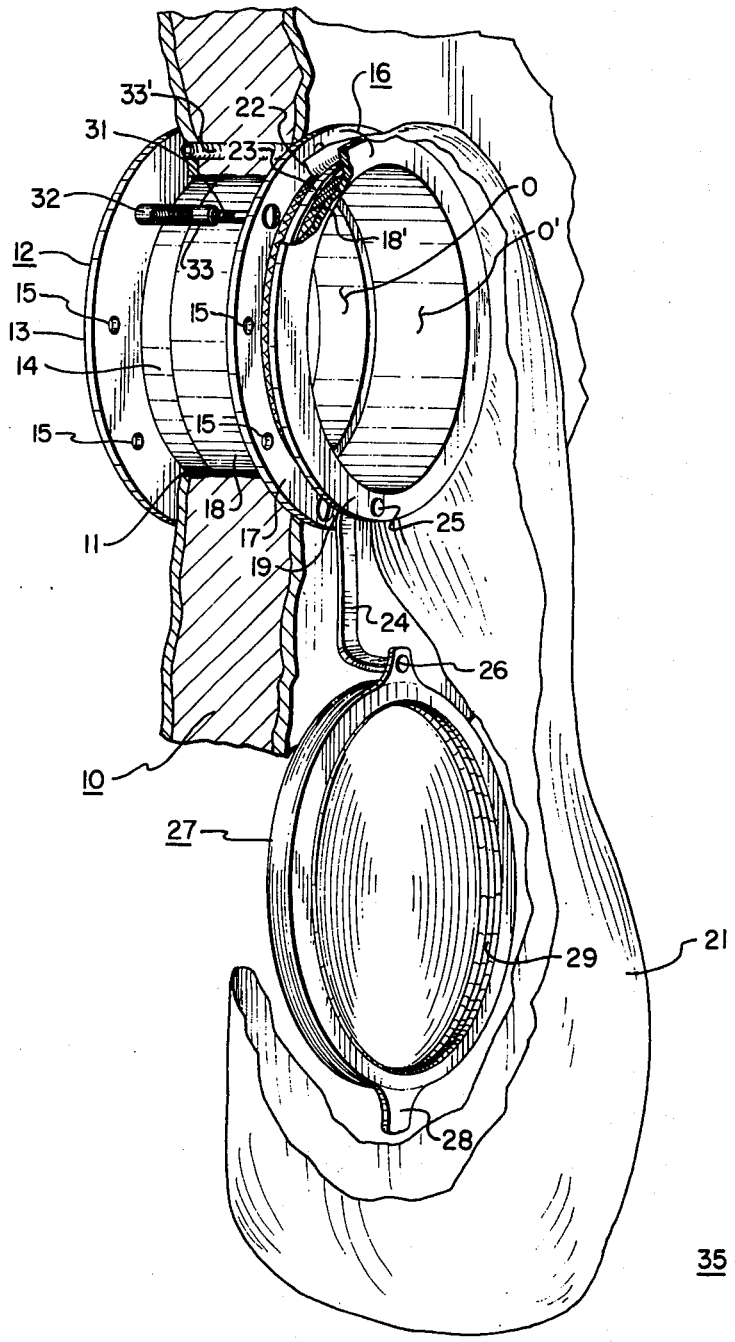
FIG. 1 is a perspective view, partially sectioned and cut away, showing the basic structural details of the subject refuse device in a preferred embodiment thereof.
Figure 2:
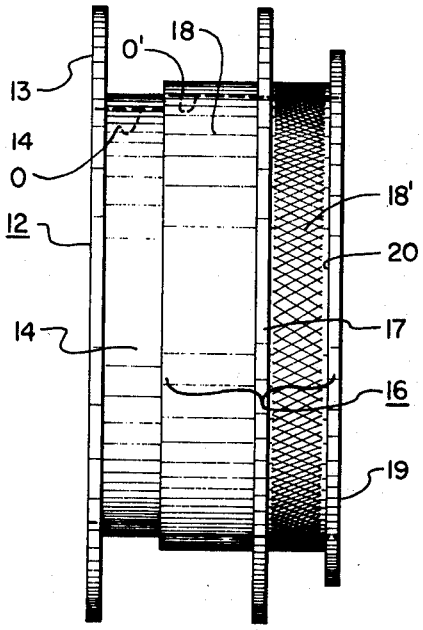
FIG. 2 is a front elevation, principally in section and showing the device in many details.

In FIG. 1 support member 10 may comprise the wall of a camper, mobile home, a conventional home, or other structure as hereinafter pointed out, and includes a through-aperture 11.

Inner tubular flange 12 is provided and includes a ring-like flange portion 13 and also a central tubular portion 14 integral therewith. Flange portion 13 may include a series of apertures 15 for mounting purposes.

Outer tubular flange 16 includes a ring-like flange portion 17 and also a central tubular portion 18. It is to be noted that, for positioning purposes, tubular portion 14 is telescopingly received by tubular portion 18. Of course, the reverse may be the case if so desired.

In any event, the outer tubular flange 16 includes an annular retention surface 18' and also a retention flange 19, conveniently termed a refuse-bag-attachment annular flange, proximate thereto or contiguous therewith. Surface 18' may be provided with serrations, a knurled surface, or the like 20 for increasing the frictional effect thereat when the same is used to support a disposable, refuse-receiving bag 21. The mouth 22 of the same may be retained in place by a rubber band 23, disposed over the bag neck which is positioned directly over the serrations of annular surface 18'.

Flexible, elongate member 24 is fixedly anchored at aperture 25 of flange portion 17 and connects to tab 26 of cover 27. The latter may include an additional finger tab 28, as well as an interior snap groove 29 for facilitating the mounting of the cover 27 over retention flange 13 when the bag 21 is to be removed.

For securement purposes, each of the flange portions 13 and 17 are provided with aligned apertures 15 for receiving suitable attachments such as suitable attachment or fastener means 31, e.g. inner and outer binder nut and screw members 32 and 33 as seen in FIG. 1. Binder screw attachments are customarily used for notebooks of various types, with one of the members being interiorly threaded and the other being exteriorly threaded. Of course, other types of securement means can be applied, such as self-tapping screws, wood screws, countersunk screws, bolt means, and so forth.

If desired, the flange portion 13 may be recessed at 34 so as to include an openable-closure member 35. The latter may be formed of a resilient material, such as an elastomer or suitable plastic, and be provided with a series of radial slots 36. This is for the purpose so that refuse may be thrust by hand through the closure member 35, the slots 36 opening and then, of course, the pie-shaped portions 37 formed by the slots returning essentially to co-planar configurement when the hand is removed. Thus, the closure member serves to keep objectionable odors and also the sight of refuse from the view of persons to the left of support member 10. If desired, a cement 38 may be used at the recess 34 for cementing the member 35 in place.

In assembly and operation, the hole or aperture 11 is initially provided in support member 10. It should be noted that in addition to the support member 10 constituting an upstanding wall, the same may comprise a vertical or horizontal member of an inexpensively produced trash container, such support member 10 being the top thereof. In any event, once the aperture 11 is provided, then the inner and outer tubular flanges 12 and 18 are simply telescopingly urged together in the manner shown in FIG. 1 and are adjusted as needed so that the apertures 30 are in alignment. Of course, these apertures 30 may be arcuately formed as arcuate slots, if desired, to facilitate the fastening function. Additionally, rather than including separate attachment apertures 33', the fasteners may be disposed simply interior of aperture 11 and yet be positioned through flange portions 13 and 17 to achieve a fastening function. While binder attachmnts have been shown, similar to those used in notebooks, it is obvious that there are many types of bolts and screws and so on that may fasten the flanges together, either directly or via screwing attachment to support member 10.

Of special interest is the inclusion of the bag retention portion or flange 13 and roughened or serrated surface 18', by which with the inclusion of rubber band 23 a refuse bag may be suspended for receiving refuse. As to operation, the user will simply thrust into the aligned openings O and O' of the two tubular flanges such refuse as is to be disposed, the same being performed preferably through closure member 35.

When the bag 21 is filled, and/or when the occupants desire to make a complete closure of the openings O and O', then the cover 27 will be replaced over retention flange 13 such that snap groove 29 receives the peripheral of retention flange 13.

Figure 3:
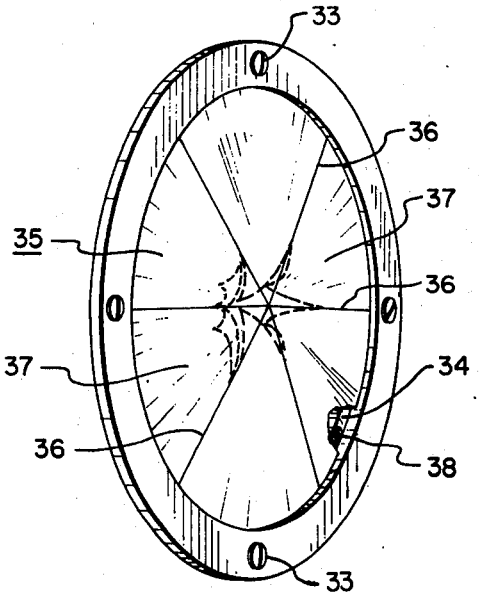
FIG. 3 is a perspective of the left-hand portion of the device in FIG. 1 wherein an openable-closure member is incorporated in the inner flange member.

For sake of convenience herein and in the claims, flange members 12 and 16 shall be referred to as ingress and egress members, corresponding to the manner and direction by which refuse is fed into the bag 21. Flexible elongate member 24 may comprise an elastomeric strap as shown or simply a ball chain or other suitable means for enabling the depending retained suspension of cap 27. The dotted lines in FIG. 3 illustrate the direction of bend of the points of the elastomeric pie sections 37 when trash is thrust forwardly therethrough. Finally, surface 18' can be roughened in any manner desired, as by knurling, by simply parallel serrations, or by any other means.

Acordingly, what is provided is a new and improved refuse device or liner, essentially, of support member apertures through which refuse is to be conducted, whereby refuse bags can be easily supported from the same and accommodate the reception of refuse as is thrust or positioned through the subject liner structure to the bag proper.

As to the bag itself the same may be made of any suitable plastic, by way of example.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

I claim:

1. A refuse passage device for installation in a pass-through aperture of a structural member, said device including, in combination, ingress and egress flange members, each having an annular, radially outwardly extending flange portion and an inner tubular portion integral with its respective flange portion, said tubular portions being in mutual telescoping cooperation, and said egress flange member also including a refuse-bag-attachment annular outwardly extending flange circumscribing the interior of said tubular portion thereof and spaced outwardly from said egress flange portion, said egress flange member being provided with a recessed surface disposed between said refuse-bag-attachment annular flange and said egress member annular flange portion, and wherein said egress flange member includes flanged cap means secured to and suspended vertically beneath said egress flange member for releasably closing and retentively fitting over said refuse-bag-attachment annular flange.

* * * * *